US009689213B2

(12) United States Patent
Khaparde et al.

(10) Patent No.: US 9,689,213 B2
(45) Date of Patent: Jun. 27, 2017

(54) ADJUSTABLE STRAIGHT BLADE STABILIZER

(71) Applicant: Halliburton Energy Services Inc., Houston, TX (US)

(72) Inventors: Ashish Prafulla Khaparde, Pune (IN); Krunal Kanubhai Mehta, Valsad (IN); Ragi Lohidakshan Poyyara, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 14/389,285

(22) PCT Filed: Dec. 3, 2013

(86) PCT No.: PCT/US2013/072720

§ 371 (c)(1),
(2) Date: Sep. 29, 2014

(87) PCT Pub. No.: WO2015/084318

PCT Pub. Date: Jun. 11, 2015

(65) Prior Publication Data

US 2016/0237762 A1 Aug. 18, 2016

(51) Int. Cl.
*E21B 17/10* (2006.01)
*E21B 7/06* (2006.01)

(52) U.S. Cl.
CPC ..... *E21B 17/1014* (2013.01); *E21B 7/067* (2013.01); *E21B 17/1078* (2013.01)

(58) Field of Classification Search
CPC ..... E21B 17/1078; E21B 17/1014
(Continued)

(56) References Cited

U.S. PATENT DOCUMENTS 3,680,646 A * 8/1972 Hughes ..... E21B 17/1078 175/323
3,818,999 A * 6/1974 Garrett ..... E21B 17/1078 175/325.4

(Continued)

FOREIGN PATENT DOCUMENTS

CN 1192796 A 9/1998
CN 2519010 Y 10/2002
CN 2864067 Y 1/2007

OTHER PUBLICATIONS

Search Report and Written Opinion of the International Searching Authority; Apr. 18, 2014; 15 pages; U.S. International Searching Authority.

(Continued)

*Primary Examiner* — Giovanna C Wright
(74) *Attorney, Agent, or Firm* — Haynes and Boone, LLP

(57) ABSTRACT

A drill string stabilizer has an elongated cavity formed in an exterior surface of the body. An elongated blade is generally disposed to extend from the cavity. The blade is extended or retracted by rotating a stud threaded on opposite ends with left and right handed threads. Rotation of the stud causes axial movement of slide blocks threadingly engaged to the stud. A follower and track between the body and the slide blocks causes the slide blocks to slidingly engage the body. The blade track is inclined relative to the body track so that the blade radially retracts or extends relative to the body as blocks are moved along their respective tracks by rotation of the stud. The position of each stabilizer blade is independent of the other blades.

18 Claims, 7 Drawing Sheets

(58) Field of Classification Search
USPC ..... 175/325.1, 325.2, 325.4, 625.5, 325.5; 166/241.1, 241.6, 241.7
See application file for complete search history.

(56) References Cited

U.S. PATENT DOCUMENTS

| | | | | |
|---|---|---|---|---|
| 4,280,742 | A * | 7/1981 | Justman | E21B 17/1078 175/325.4 |
| 4,765,417 | A * | 8/1988 | Perkin | E21B 10/22 175/347 |
| 5,836,406 | A | 11/1998 | Schuh | |
| 7,204,325 | B2 | 4/2007 | Song et al. | |
| 2008/0128174 | A1 | 6/2008 | Radford et al. | |

OTHER PUBLICATIONS

Chinese Office Action, CN 201380080369.1, Jan. 22, 2017, 8 pages.

* cited by examiner

FIG. 10
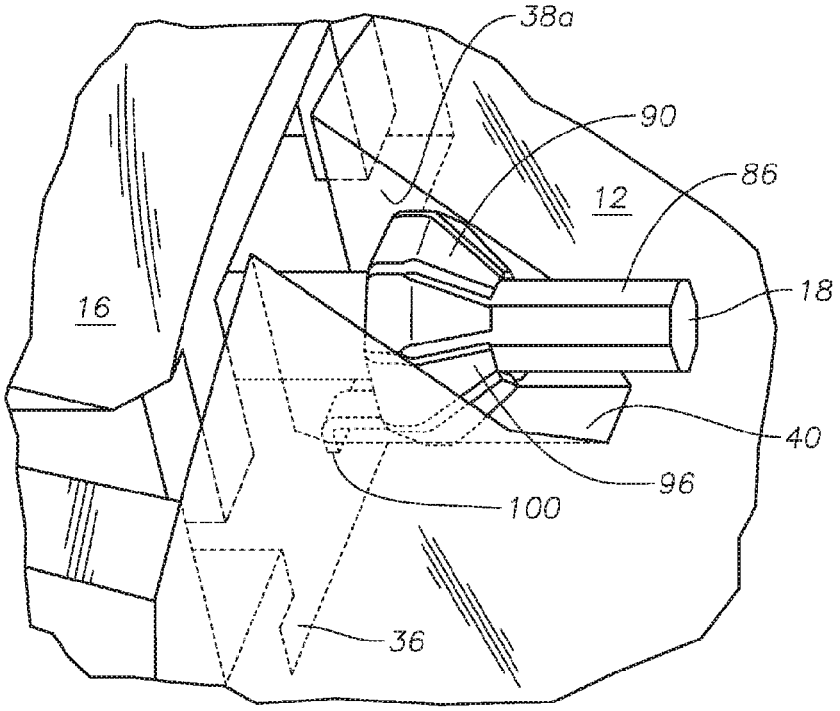
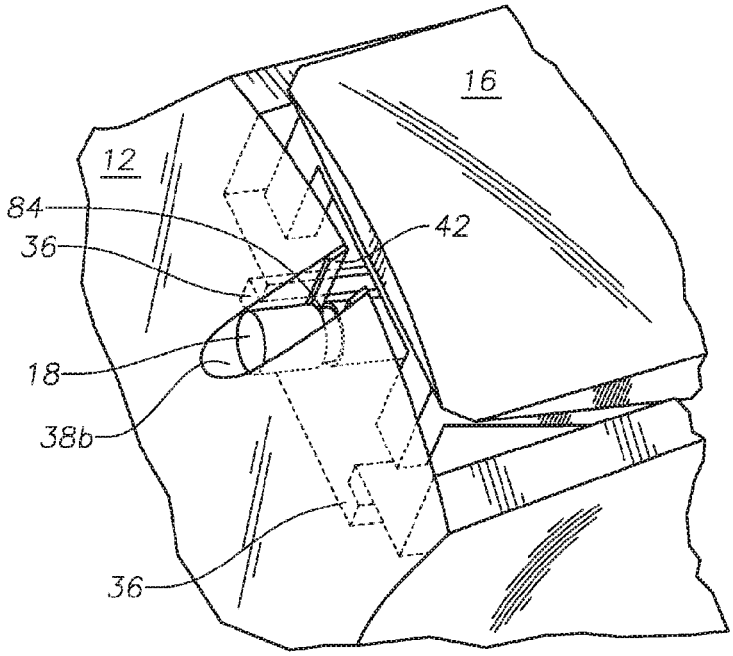
FIG. 11

ADJUSTABLE STRAIGHT BLADE STABILIZER

CROSS REFERENCE TO RELATED APPLICATIONS

The present application is a U.S. National Stage patent application of International Patent Application No. PCT/US2013/072720, filed on Dec. 3, 2013, the benefit of which is claimed and the disclosure of which is incorporated herein by reference in its entirety.

FIELD OF THE INVENTION

The present invention relates generally to stabilizer assemblies for use in drilling of oil and gas wellbores. More specifically, the present invention is related to adjustable stabilizers to control the direction of drilling of wellbores.

BACKGROUND OF THE INVENTION

It is well known in the art of drilling oil and gas wells, to place stabilizers along the drill string to mechanically stabilize the drill string. In particular, stabilizers are used to maintain a preferred spacing between the axis of the drill string and the side of the wellbore. As such, stabilizers can prevent differential sticking, especially when positioned in the drill string adjacent the drill bit. Moreover, stabilizers can be utilized to increase the stiffness of a drill string, particularly when incorporated as part of the bottom hole assembly (BHA).

Stabilizers can also be used control the direction of drilling of the wellbore, either by maintaining a strait trajectory for the drill bit path or by inducing a deviation in the path of the drill bit.

Typically, stabilizers are comprised of elongated, axial blades extending from the stabilizer body. The blades are either straightor spiral in orientation and integrally formed as part of the body. Such stabilizers are often referred to as "fixed blade" stabilizers. Fixed blade stabilizers have a predetermined diameter and thus, are disposed only to maintain a predetermined offset of the drill string axis from the side of the wellbore.

When a drill string is made up, afixed blade stabilizer having a predetermined diameter is inserted between drill pipe or collar sections and the pipe is tripped into the wellbore. The stabilizer maintains the spacing of the drillstring from the wellbore wall at the predetermined offset distance. To the extent it is desired to alter the offset distance, the fixed blade stabilizer must be tripped out of the wellbore, the drillstring broken and a stabilizer having the preferred diameter inserted into the drillstring.

Another type of stabilizer is the adjustable blade stabilizer. Adjustable blade stabilizers are most often utilized as part of a directional drilling assembly and include stabilizer blades disposed to be moved radially outward by an actuation mechanism, such as a mud driven piston, once the stabilizer is in a desired location downhole. During deployment, the stabilizer blades are in a retracted position in order to minimize the diameter of the stabilizer. Most commonly, the actuation mechanism is actuated by hydraulic flow through the drill string, thereby causing radial extension of the stabilizer blades. Often, the stabilizers retract when hydraulic flow is interrupted or drops below a predetermined pressure.

BRIEF DESCRIPTION OF THE DRAWINGS

FIG. 10 illustrates an end of the threaded stud engaged with the body upstring end FIG. 11 illustrates an end of the threaded stud engaged with the body at downstring end

DETAILED DESCRIPTION

Figure 1:
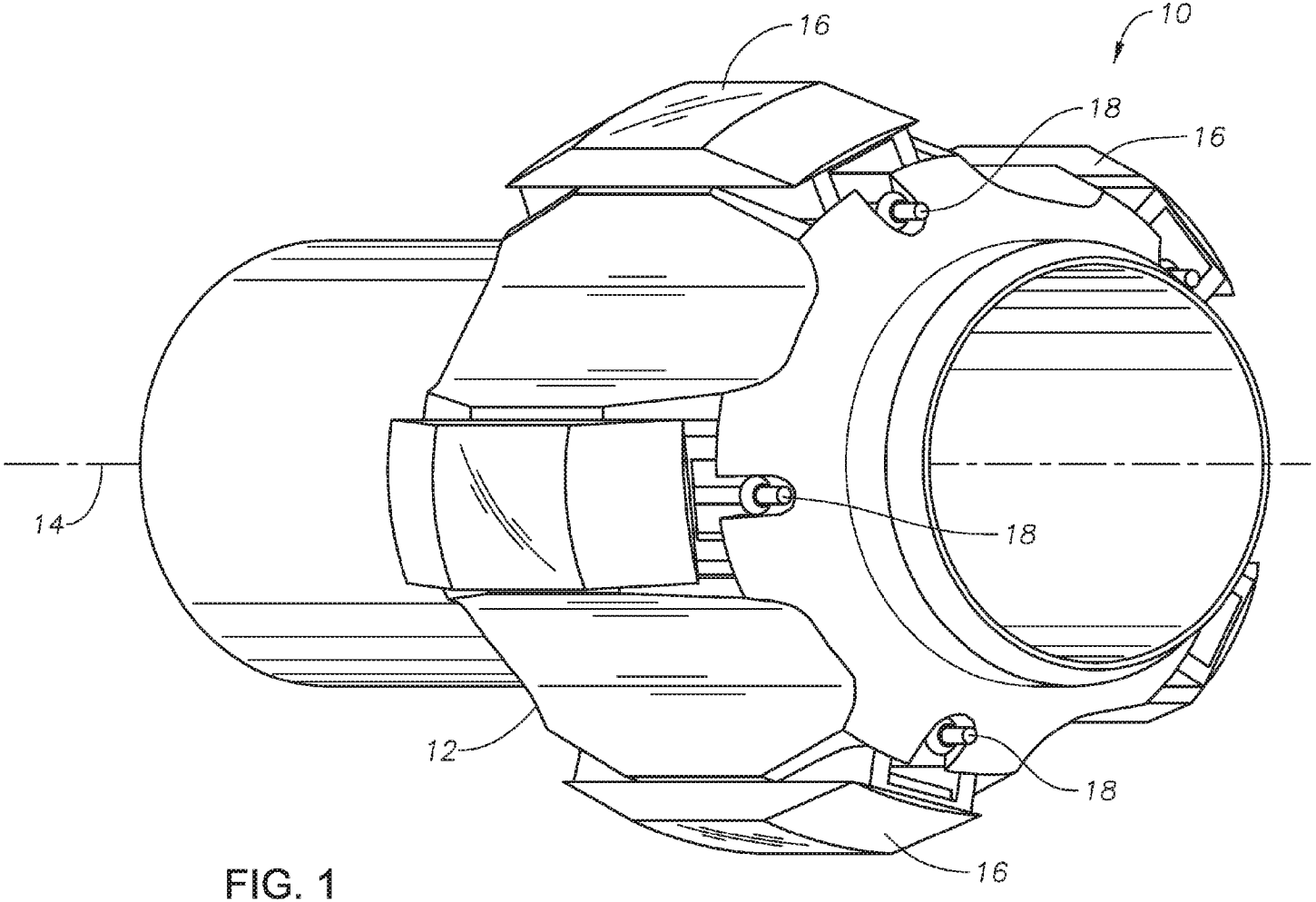
FIG. 1 illustrates an adjustable straight blade stabilizer according to some embodiments.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstring" or "downstring" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

With reference to FIG. 1, an adjustable straight blade stabilizer 10 is illustrated. Stabilizer 10 generally includes a body 12 defined along an axis 14. Body 12 has one, and preferably multiple, elongated stabilizer blades 16 positioned around the perimeter of body 12. Preferably blades 16 are equally spaced about the perimeter of body 12. Each blade 16 is disposed to radially extend and retract in response to actuation of a threaded stud 18.

Figure 2:
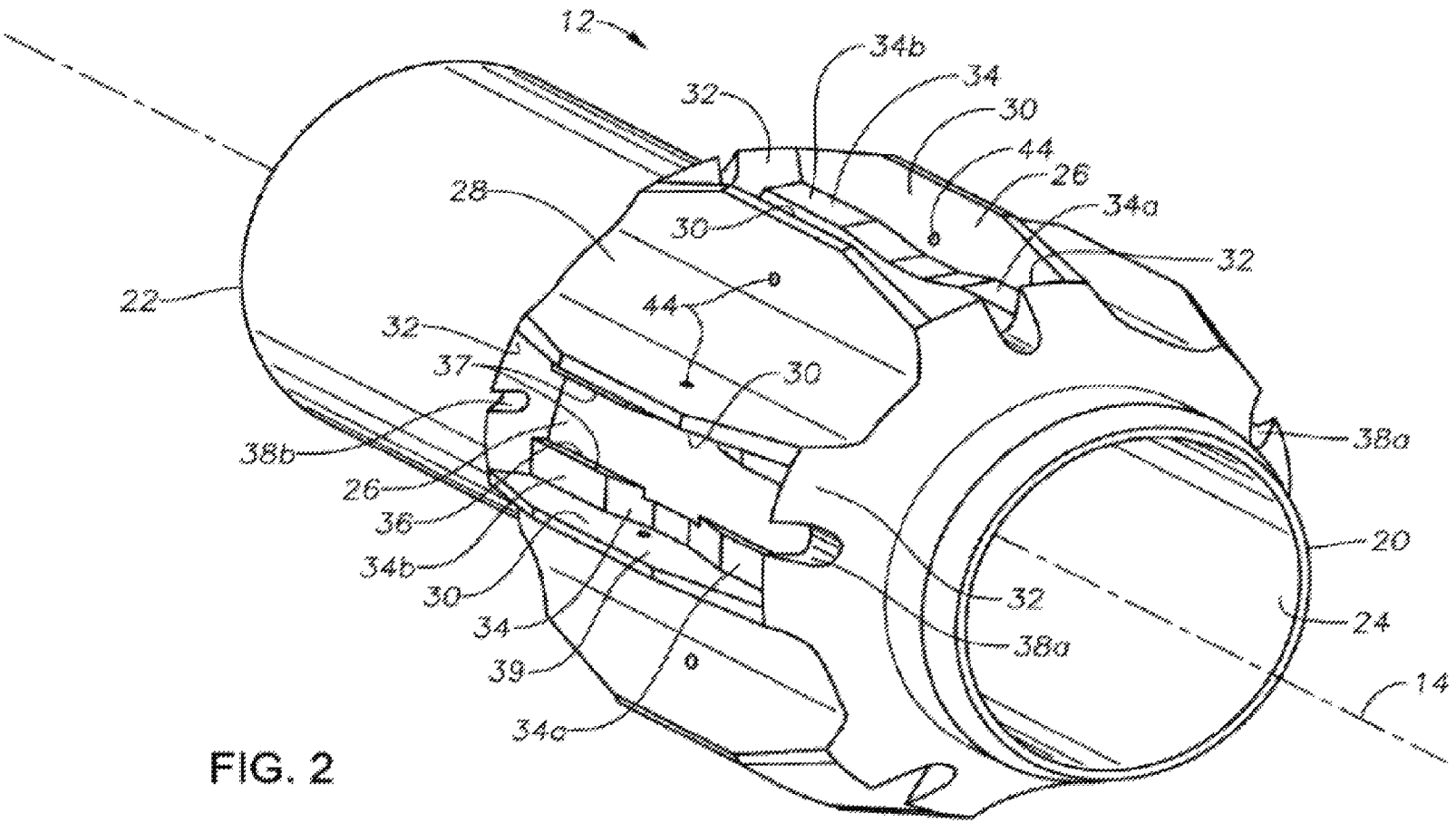
FIG. 2 illustrates the body of the stabilizer of FIG. 1.

FIG. 2 illustrates body 12 in greater detail. Generally body 12 has a first downhole/bit end end 20 and a second uphole end 22 with a through bore 24 extending between ends 20, 22. Each end 20, 22 may be threaded, in a manner well known in the art, to secure stabilizer 12 to a pipe string (not shown).

For each blade 16 (see FIG. 1) body 12 has an elongated cavity 26 formed in an exterior surface 28 of body 12. Each cavity 26 is disposed to be parallel to axis 14. Cavity 26 is defined by opposing side walls 30 and opposing end walls 32. Associated with each cavity 26 is a first track 34. In certain embodiments, first track 34 is formed within cavity 26, positioned between side walls 30 and extending from one end wall 32 to the other end wall 32. In certain embodiments, track 34 is preferably substantially parallel with the elongated axis 14 of body 12.

Figure 8:
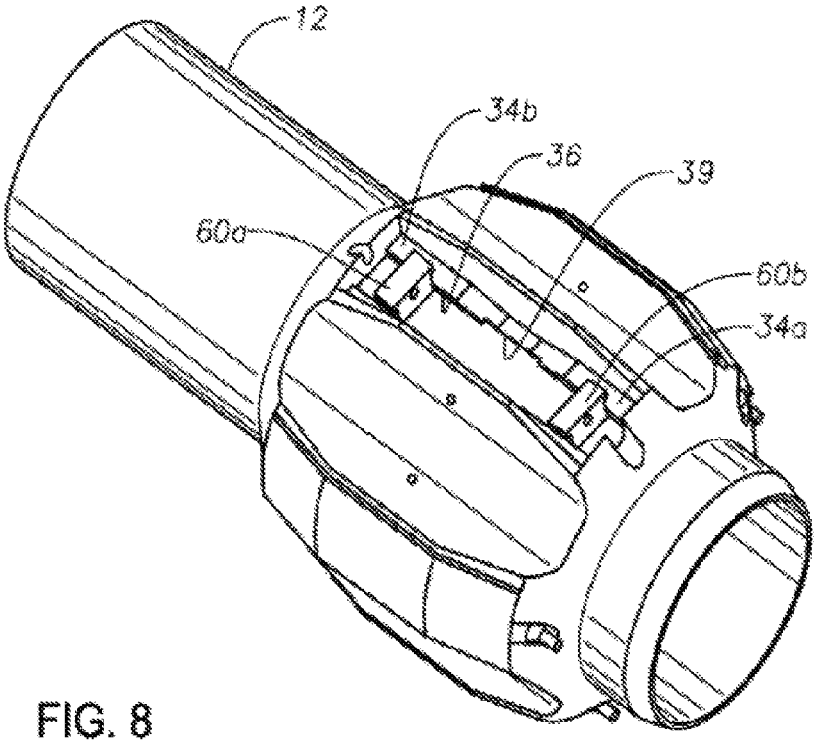
FIG. 8 illustrates sliding blocks engaged with the tracks of the body.

In certain embodiments, track 34 may be formed of spaced apart grooves 36 (see also, FIGS. 8, 10 and 11). Grooves 36 may be suitably formed in cavity 26. For example, grooves 36 may be formed in a lip 37 formed at the base of opposing side walls 30. In this embodiment, track 34 is characterized by a first portion 34*a* adjacent a first end of the cavity 26 and a second portion 34*b* adjacent the second uphole end of the cavity 26 and having an opening 39 defined in track 34 between the first and second portions 34*a*, 34*b*.

Each end wall 32 functions as a stop disposed along each track portion 34*a*, 34*b* adjacent the respective ends of the cavity 26. Moreover, each end wall 32 has a slot 38 formed therein. Preferably, each slot 38 is U-shaped. With reference to FIGS. 10 and 11, and ongoing reference to FIG. 2, one of the slots 38*a* is defined by at least one, and preferably multiple, flat surfaces 40, while the other slot 38*b* has a rib 42 projecting into the slot 38*b*.

As shown in FIGS. 1 and 2, body 12 may also include an aperture 44 formed in and extending through side wall 30 from the interior of cavity 26 to the exterior surface 28 of body 12.

Figure 3A:
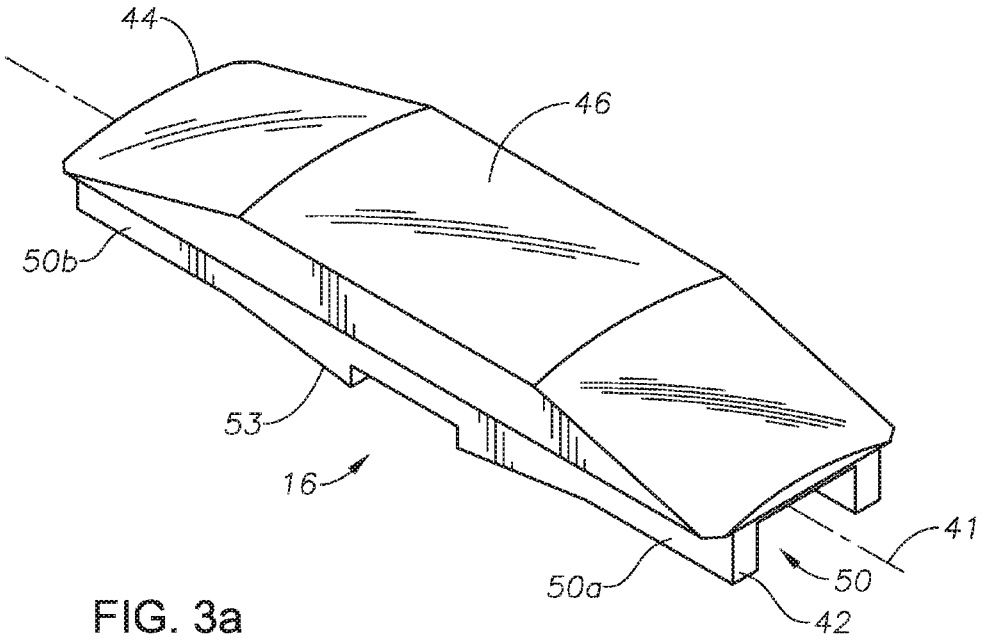
FIGS. 3*a* and 3*b* illustrate the stabilizer blade of an adjustable straight blade stabilizer according to some embodiments.
Figure 3B:
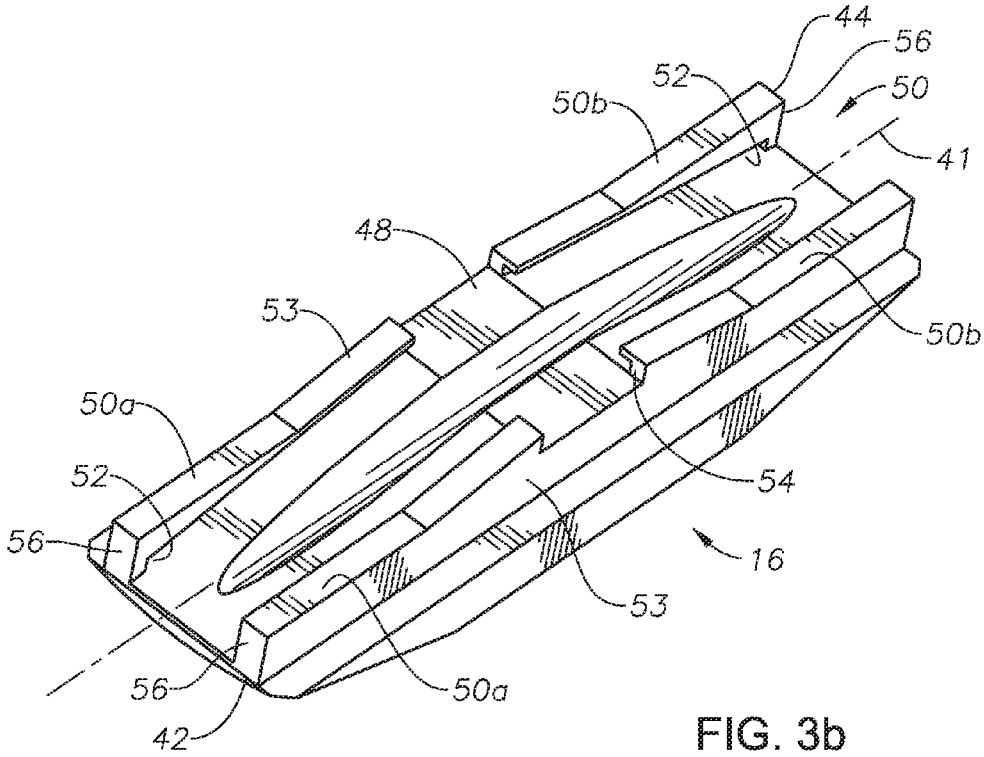

With reference to FIGS. 3*a* and 3*b*, blade 16 is illustrated in greater detail. Preferably, blade 16 is elongated in the general shape of cavity 26 of body 12 (see FIG. 1). Blade 16 is formed along an axis 41 and characterized by a first downhole/bit end 42, a second uphole end 44, an outer surface 46 and an inner surface 48. Outer surface 46 is disposed for contact with the wall of a wellbore (not shown). Associated with each blade 16 is a second track 50. In certain embodiments, second track 50 is formed on inner surface 48 and extends from one end 42 to the other end 44 of blade 16.

Figure 6:
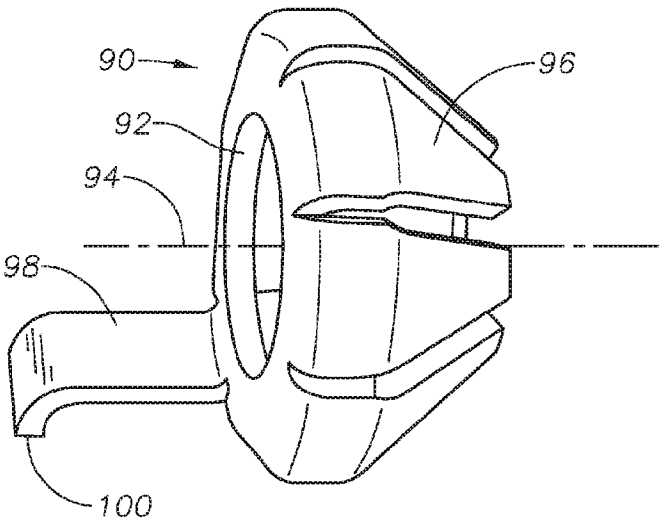
FIG. 6 illustrates a locking ring of an adjustable straight blade stabilizer according to some embodiments.

In certain embodiments, track 50 may be formed of spaced apart grooves 52 (see also, FIG. 6). Grooves 52 may be suitably formed in blade 16. For example, grooves 52 may be formed in a opposing side walls 53 of blade 16. In certain embodiments, grooves 52 are U-shaped in cross-section, thereby forming a flow passage. In this embodiment, track 50 is characterized by a first portion 50*a* adjacent end 42 of blade 16 and a second portion 50*b* adjacent the second end 44 of blade 16 and having an opening 54 defined in track 50 between the first and second portions 50*a*, 50*b*.

In certain embodiments, track 50 is preferably inclined relative to the elongated axis 41 of blade 16 (and body 12 when blade 16 is attached thereto).

In certain embodiments, the first portion 50*a* is inclined between the opening 54 and the first end 42 of blade 16 and the second portion 50*b* is inclined between the opening 54 and the second end 44 of blade 16 such that spacing between each track portion 50*a*, 50*b* and axis 41 of blade 16 along which the inner surface 48 is formed gradually increases along the length of the track portion 50*a*, 50*b* from the opening 54 to the respective ends 42, 44 of blade 16.

It will be appreciated that track 34 of body 12 (see FIG. 2) and track 50 of blade 16 (see FIGS. 3*a* and 3*b*) function cooperatively because one track is inclined relative to the other track. While certain embodiments describe the track 34 of body 12 as being substantially parallel with axis 14 while track 50 of blade 16 is inclined, the opposite arrangement is also contemplated, wherein track 34 is inclines and track 50 is parallel.

An end wall 56 functions as a stop disposed along each track portion 50*a*, 50*b* adjacent the respective ends 42, 44 of blade 16.

Figure 4:
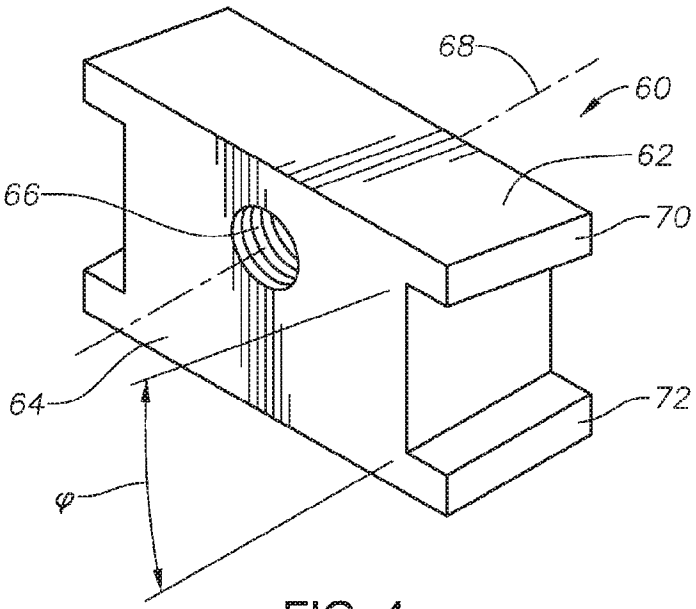
FIG. 4 illustrates a sliding block of an adjustable straight blade stabilizer according to some embodiments.

Turning to FIG. 4, a sliding block 60 of stabilizer 10 is illustrated. Sliding block 60 has a top 62 and a bottom 64 and a threaded through bore 66 defined along an axis 68 passing through block 60.

In certain embodiments, block 60 includes a first follower 70 adjacent the top 62 and a second follower 72 adjacent the bottom 64. As will be explained, first follower 70 is generally disposed to slidingly engage track 50 of blade 16, while second follower 72 is generally disposed to slidingly engage track 34 of body 12. Together, a track (such as track 50 or track 34) and a follower function as a guideway assembly in which the follower engages the track such that movement of the follower relative to the track is constrained to sliding movement along the track. In other embodiments, a track may be formed on the block and the follower may extent from the corresponding component, i.e., the body or the blade. In other words, the track may be formed on the stabilizer body or the movable blade with the follower formed on a sliding block or vice versa. "Track" and "follower" as described herein should be understood to be any arrangement where a sliding mechanical coupling is formed whereby the follower is constrained to movement along the track. Moreover, it is understood that while the track is described as being formed on certain components, while the follower is described as being formed on other components, the arrangement of the track and follower on the various components may be reversed as long as a sliding mechanical coupling is maintained. As non-limiting examples, the track may be a rail slidingly engaged by a bore formed in a component, such as a follower, or the track may be a slot slidingly engaged by a flange.

Preferably, the follower that engages the inclined track is likewise formed with an angle or incline. Thus, in FIG. 4, follower 70 may include an inclined surface 70' (for engagement with inclined track 50 of blade 16 shown in FIG. 3*b*). As shown, follower 70, and in particular surface 70', is formed along a plane that has an angle or incline of θ with respect to the axis 68 of block 60. Follower 72 is generally formed along a plane that is parallel with axis 68.

In the embodiment of FIG. 4, the first and second followers 70, 72 are flanges that extend from sliding block 60.

Figure 7:
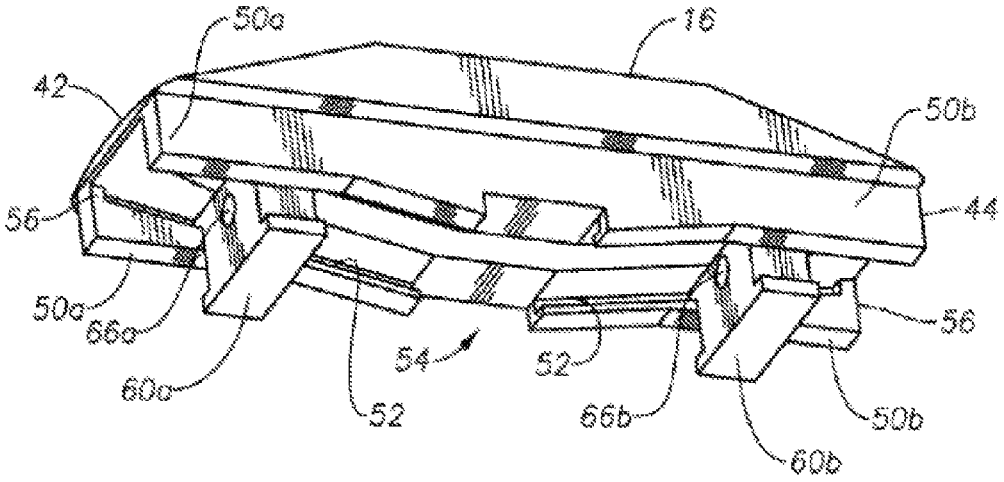
FIG. 7 illustrates sliding blocks engaged with the tracks of the stabilizer blade.

With reference to FIGS. 7 and 8 and on-going reference to FIG. 4, stabilizer 10 may include two sliding blocks 60, namely sliding block 60*a* and sliding block 60*b*. In these embodiments, sliding block 60*a* includes a through bore 66*a* with left-handed threads and sliding block 60*b* includes a through bore 66*b* with right-handed threads. It will be appreciated in light of the following that two sliding blocks provide added stability to blade 16.

Figure 5:
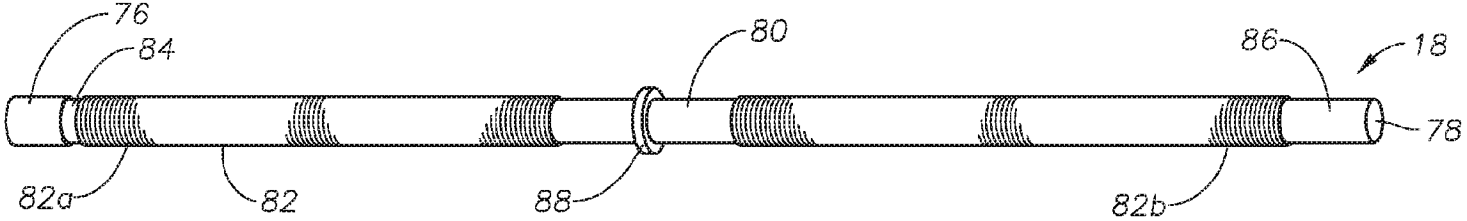
FIG. 5 illustrates the threaded stud of an adjustable straight blade stabilizer according to some embodiments.

Turning now to FIG. 5, threaded stud 18 is illustrated in more detail. Threaded stud 18 is characterized as having a first end 76 and a second end 78 and having an exterior surface 80 having threads 82 at least partially formed thereon between the first end 76 and the second end 78. Threads 82 are disposed to be engaged by the threaded through bore 66 of block 60.

In embodiments of stabilizer 10 that include a sliding block 60*a* with a left-handed through bore 66*a* and a sliding block 60*b* with a right-handed through bore 66*b*, the threaded surface 80 of stud 18 may include a first threaded portion 82*a* adjacent the first end 76 of stud 18 and a second threaded portion 82*b* adjacent the second end 78 of stud 18, wherein one portion of the threads is right-handed and the other portion of the threads is left-handed to correspond with the block 60 threadingly engaged to that portion of threaded surface.

As shown in FIGS. 5 and 11, stud 18 may also include a radial notch 84 formed in the exterior surface 80 adjacent one end of stud 18. Likewise, as shown in FIGS. 5 and 10, the exterior surface 80 of stud 18 may include a portion 86 that is polygonal in cross-section. In FIG. 10, portion 86 is illustrated as octagonal in cross-section.

As shown in FIG. 5, stud 18 may also include a shoulder 88 formed between the right-handed and left-handed portions 82*a*, 82*b* of the threaded surface.

FIG. 6 illustrates an optional locking mechanism 90 that may be included in some embodiments of stabilizer 10. Locking mechanism 90 is formed of ring base 92 defined around an axis 94. At least one, and preferably a plurality of fingers 96 are disposed on a perimeter of the ring base 92. Each finger 96 is biased inward from the perimeter towards the axis 94 of the locking mechanism 90. Preferably, fingers 96 have some flexibility relative to base 92 so that the fingers can engage and grip stud 18 (not shown) when deployed thereon. In this regard, each finger 96 may include a flat edge at the distal end to enhance engagement. Locking mechanism 90 may also include an arm 98 extending from the ring base 92 away from the fingers 96 in a direction opposite the fingers 96. A tab 100 extends radially outward from the distal end of arm 98.

Locking mechanism 90 is utilized to prevent rotation of stud 18 once the radial position of blades 16 has been set for stabilizer 10. It will be appreciated that the above-description is but one embodiment of a lock mechanism to accomplish the task of securing the stud 18 from rotation once the position of blades 16 have been set. However, other locking mechanisms are contemplated. For example, stud 18 may be threaded at end 78 rather than polygonally shaped, and a square bolt could be threaded onto end 78 which bolt could include an outer perimeter disposed to engage a similarly shaped inner perimeter of slot 38*a*.

Figure 9:
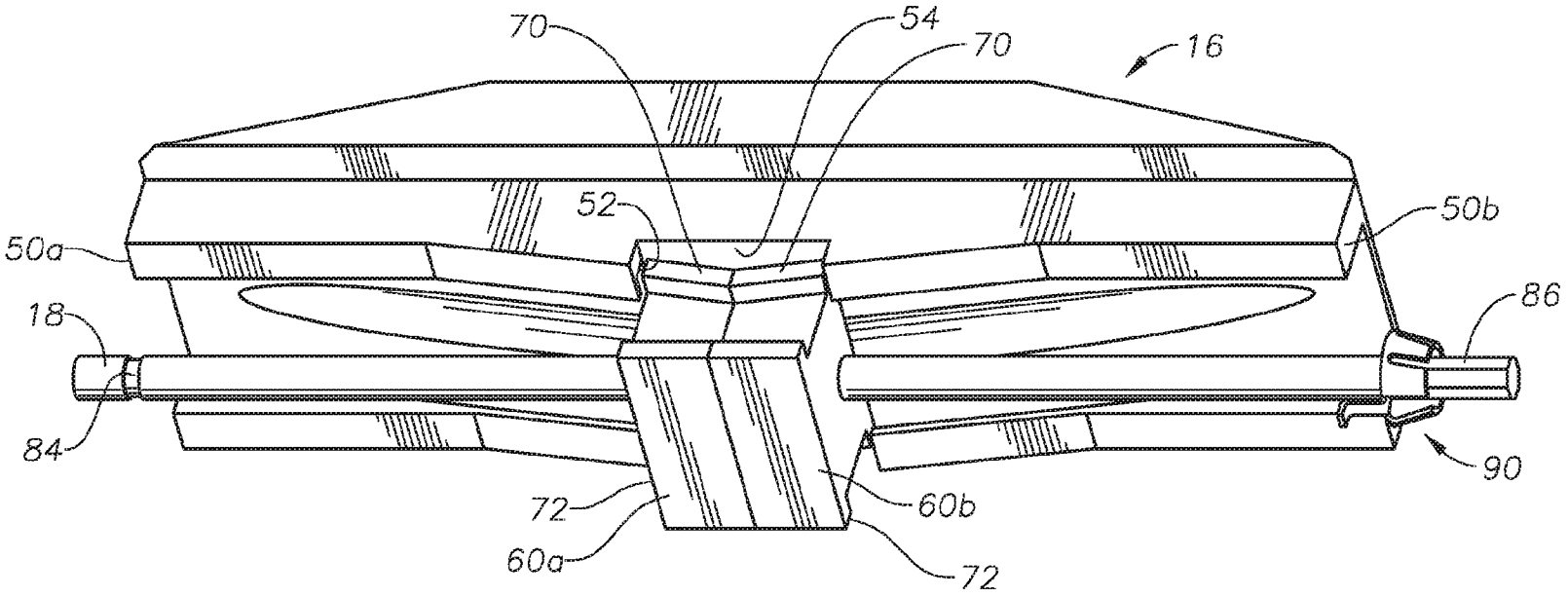
FIG. 9 illustrates sliding blocks disposed for assembly to the stabilizer blade.

FIGS. 7 and 8 illustrate the engagement of sliding blocks 60*a*, 60*b* with the blade 16 and body 12, respectively. Specifically, follower 70 of blocks 60*a*, 60*b* slidingly engages grooves 52 of first track portion 50*a* and second track portion 50*b*, respectively. As such, block 60*a* is constrained to slidingly move, relative to blade 16, along first track portion 50*a* and block 60*b* is constrained to slidingly move along second track portion 50*b*. Likewise, follower 72 of blocks 60*a*, 60*b* slidingly engages grooves 36 of first track portion 34*a* and second track portion 34*b*, respectively. As such, block 60*a* is constrained to slidingly move, relative to body 12, along first track portion 34*a* and block 60*b* is constrained to slidingly move along second track portion 34*b*. Opening 54 of blade 16 and opening 39 of body 12 permit the followers of the blocks 60*a*, 60*b* to engage their respective track portions. This is best illustrated in FIG. 9, where blocks 60*a*, 60*b* are disposed on their respective threaded portions 82*a*, 82*b* of stud 18 so that they are adjacent one another at shoulder 88. In such a position, followers 70 of blocks 60*a*, 60*b* can be positioned in opening 54 so that the followers 70 are aligned with their respective track portions 50*a*, 50*b*. Rotation of stud 18 will cause blocks 60*a*, 60*b* to move apart from one another due to their respective threads, thereby causing each follower 70 to engage the groove 52 of its respective track portion 50*a*, 50*b*. Followers 72 are likewise positioned in window 39 of body 12 contemporaneously so that rotation of stud 18 also causes each follower 72 to engage the groove 36 of respective track portions 34*a*, 34*b*. Moreover, when followers 72 are so positioned in window 39, first end 76 of stud 18 engages slot 38*b* so that rib 42 seats in notch 84 to axially constrain movement of stud 18 relative to body 12 Likewise, second end 78 of stud 18 projects through slot 38*b* to permit stud 18 to be engaged and rotated until the desired radial position of blade 16 is achieved.

The result of engaging followers 70, 72 of blocks 60*a*, 60*b* as described above with their respective tracks 34, 50 of body 12 and blade 16 is that blade 16 is thereby engaged with and secured to body 12. Continued rotation of stud 18 causes blocks 60*a*, 60*b* to move apart. At blocks 60*a*, 60*b* move apart, the incline of track 50 causes blade 16 to move radially inward relative to body 12 until the desired position of blade 16 is achieved. Thus, blade 16 is at its greatest radial expansion when blocks 60*a*, 60*b* are closest to opening 54, and blade 16 is at its greatest radial retraction when blocks 60*a*, 60*b* are closest to stops 56.

Once the desired position of blade 16 is achieved, locking mechanism 90 can be disposed on second end 78 to prevent further rotation of stud 18. Fingers 96 engage the flat portions of surface 80 of stud 18, as shown in FIG. 10. Moreover, ring base 92 seats in slot 38*b* so that rotation of ring base 92 relative to body 12 is prevented. Likewise, arm 98 extends towards cavity 26 so that tab 100 can engage wall 32, thereby preventing outward axial movement of locking mechanism 90 relative to stud 18.

The adjustable straight blade stabilizer described herein permits a single straight blade stabilizer to be used in multiple wellbore hole sizes with variable under-gage dimensions. This eliminates the need for different inventory of stabilizers for different hole-sizes and under-gage dimensions. In practice, adjustment to the blade position is made on the surface before commencement of drilling. In certain embodiments, since the two sliding blocks and two ends of the stud have opposite threads on it, rotation of the stud cause each block to move in opposite directions. In other words, based on clockwise or anticlockwise rotation of the stud, the sliding blocks move towards or away from each other. The inclination on the track of the movable blade on either end, together with the angle of the follower of the sliding block assist in pushing the blade outward as the sliding blocks move towards each other. In this way, different diameters on the blade can be achieved just by rotating the stud.

This system is exposed to the drilling mud that flows back to the surface. This mud can enter the stabilizer body through the U-shaped slots on the stabilizer body where the stud rests. Air entrapment in the stabilizer due to mud invasion is addressed by providing apertures in the walls of the stabilizer body to permit air to escape therethrough. In addition, mud invasion also addressed by means of the spaced apart slots at the base of the stabilizer blade that form a U-shaped track. This mud is made to travel along and past the blade via the U-shaped slot formed by the track on the bottom of the blade. The invention caters to different hole sizes, without the need for maintaining a large inventory of stabilizers of different sizes. Moreover, the system permits the position of each blade to be adjusted independently, so that a particular position of the drillstring in the wellbore may be achieved. Thus, for example, blades on one portion of the stabilizer may be extended or retracted to a greater degree than blades on a different a portion.

Thus, a stabilizer for use in a drill string has been described. Embodiments of the stabilizer may generally have a body characterized by an elongated axis, the body having an elongated cavity formed in an exterior surface of the body with a track formed along the cavity; an elongated stabilizer blade having a first end, a second end, an outer surface and an inner surface with a track formed along the inner surface; a sliding block having a first follower disposed to slidingly engage the track of the stabilizer blade, a second follower disposed to slidingly engage the track of the body and a threaded through bore formed in the block along a through bore axis; and an elongated shaft having a first end and a second end and having an exterior surface at least partially threaded between the first end and the second end, wherein the threaded surface of the shaft engages the threaded through bore of the block. Other embodiments of the stabilizer may generally include a body characterized by an elongated axis, the body having an elongated cavity formed in an exterior surface of the body; an elongated stabilizer blade having a first end, a second end, an outer surface and an inner surface with a track formed along the inner surface; a sliding block having top, a bottom and a threaded through bore formed in the block along a through bore axis; an elongated shaft having a first end and a second end and having an exterior surface at least partially threaded between the first end and the second end, wherein the threaded surface of the shaft engages the threaded through bore of the sliding block; and a guideway assembly, the guideway assembly comprising a first track and first follower slidingly securing the bottom of the sliding block to the body and a second track and second follower slidingly securing the top of the sliding block to the removable blade. For any of the foregoing embodiments, the stabilizer may include any one of the following elements, alone or in combination with each other:

- tracks are inclined relative to the elongated axis of the body;
- the track of the body is substantially parallel with the elongated axis of the body and the track of the blade is inclined relative to the axis of the elongated body;
- each track comprises a set of spaced apart grooves;
- the track of the blade comprises a first portion adjacent the first end of the blade and a second portion adjacent the second end of the blade and having an opening defined in the track between the first and second portions;
- the first portion of the track of the blade is inclined between the opening and the first end and the second portion of the track of the blade is inclined between the opening and the second end, wherein spacing between each track portion and the inner surface gradually increases along the length of the track portion from the opening to the respective ends of the blade;
- a shoulder forming a stop disposed along each track portion adjacent the respective ends of the blade;
- a first sliding block and a second sliding block, each sliding block having a threaded bore formed therein, wherein the threaded bore of the first sliding block comprises left-handed threads and the threaded bore of the second sliding block comprises right-handed threads;
- the first follower is formed along a plane that forms an angle with the axis of the through bore and the second follower is formed along a plane that is parallel with the axis of the through bore;
- the first and second followers are flanges that extend from the sliding block;
- the threaded surface of the elongated shaft comprises a first threaded portion adjacent the first end of the shaft and a second threaded portion adjacent the second end of the shaft, wherein one portion of the threads is right-handed and the other portion of the threads is left-handed;
- a radial notch is formed in the exterior surface of the elongated shaft adjacent one end of the shaft;
- the exterior surface of the elongated shaft adjacent one end is polygonal in cross-section;
- a shoulder formed between the right-handed and left-handed portions of the threaded surface;
- between 2 and 6 blades evenly spaced around the perimeter of the stabilizer body;
- the body comprises an interior through bore axially formed therein;
- the body comprises an upper threaded end and a lower threaded end, the threaded ends disposed to engage threads of a drill string;
- the track of the body comprises a first portion adjacent a first end of the cavity and a second portion adjacent the second end of the cavity and having an opening defined in the track between the first and second portions;
- the body further comprises a shoulder forming a stop disposed along each track portion adjacent the respective ends of the cavity;
- the body is further defined by a slot formed at each end of the cavity;
- the slots are U-shaped slots;
- the body further comprises a rib projecting into the slot at one end of the body;
- the slot at one end of the body is formed by at least one flat surface;
- the cavity is defined by elongated opposing walls formed in the body;
- the body further comprises an aperture defined in at least one wall, the aperture extending through the wall to an exterior surface of the body;
- a locking mechanism mounted on an end of the elongated shaft, the lock washer comprised of a ring defined around an axis, the ring having at least 3 fingers disposed on a perimeter of the ring, wherein each finger is angled from the perimeter towards the axis of the ring, the lock washer further comprising an arm extending from the ring away from the fingers in a direction opposite the fingers, the arm having a tab extending radially outward; and
- each finger of a locking mechanism has a flat distal end.

Moreover, embodiments of a stabilizer may generally be characterized as having a body characterized by an elongated axis, the body having an elongated cavity formed in an exterior surface of the body; an elongated stabilizer blade having a first end, a second end, an outer surface and an inner surface with a track formed along the inner surface; a sliding block having top, a bottom and a threaded through bore formed in the block along a through bore axis; an elongated shaft having a first end and a second end and having an exterior surface at least partially threaded between the first end and the second end, wherein the threaded surface of the shaft engages the threaded through bore of the sliding block; and a guideway assembly, the guideway assembly comprising a first track and first follower slidingly securing the bottom of the sliding block to the body and a second track and second follower slidingly securing the top of the sliding block to the removable blade. For any of the foregoing embodiments, the stabilizer may include any one of the following elements, alone or in combination with each other:

- the first track is disposed within the elongated cavity of the body and the first follower extends from adjacent the bottom of the sliding block;
- the second track is disposed adjacent the inner surface of the blade and the second follower extends from adjacent the top of the sliding block; and each track comprises a set of spaced apart grooves and each follower comprises two flanges extending from the sliding block and disposed to engage the respective grooves of the tracks;

While the foregoing disclosure is directed to the specific embodiments of the disclosure, various modifications will be apparent to those skilled in the art. It is intended that all variations within the scope and spirit of the appended claims be embraced by the foregoing disclosure.

We claim:

1. A stabilizer for use in a drill string, the stabilizer comprising:

a body with an elongated axis, the body having an elongated cavity formed in an exterior surface of the body with a track formed along the cavity;

an elongated stabilizer blade having a first end, a second end, an outer surface and an inner surface with a track formed along the inner surface;

a sliding block having a first follower disposed to slidingly engage the track of the stabilizer blade, a second follower disposed to slidingly engage the track of the body and a threaded through bore formed in the block along a through bore axis; and an elongated shaft having a first end and a second end and having an exterior surface at least partially threaded between the first end and the second end, wherein the threaded surface of the shaft engages the threaded through bore of the block;

wherein the track of the body is substantially parallel with the elongated axis of the body and the track of the blade is inclined relative to the elongated axis of the body.

2. The stabilizer of claim 1, wherein each track comprises a set of spaced apart grooves.

3. The stabilizer of claim 1 or 2, wherein the track of the blade comprises a first portion adjacent the first end of the blade and a second portion adjacent the second end of the blade and having an opening defined in the track between the first and second portions, wherein the first portion of the track of the blade is inclined between the opening and the first end and the second portion of the track of the blade is inclined between the opening and the second end, wherein spacing between each track portion and the inner surface gradually increases along the length of the track portion from the opening to the respective ends of the blade.

4. The stabilizer of claim 1 or 2, comprising a first sliding block and a second sliding block, each sliding block having a threaded bore formed therein, wherein the threaded bore of the first sliding block comprises left-handed threads and the threaded bore of the second sliding block comprises right-handed threads.

5. The stabilizer of claim 1 or 4, wherein the first follower is formed along a plane that forms an angle with the axis of the through bore and the second follower is formed along a plane that is parallel with the axis of the through bore, wherein the first and second followers are flanges that extend from the sliding block.

6. The stabilizer of claim 1, wherein the threaded surface of the elongated shaft comprises a first threaded portion adjacent the first end of the shaft and a second threaded portion adjacent the second end of the shaft, wherein one portion of the threads is right-handed and the other portion of the threads is left-handed.

7. The stabilizer of claim 6, wherein the exterior surface of the elongated shaft adjacent one end is polygonal in cross-section.

8. The stabilizer of claim 1, wherein the body comprises an interior through bore axially formed therein.

9. The stabilizer of claim 1, wherein the body comprises an upper threaded end and a lower threaded end, the threaded ends disposed to engage threads of a drill string.

10. The stabilizer of claim 1, wherein the track of the body comprises a first portion adjacent a first end of the cavity and a second portion adjacent the second end of the cavity and having an opening defined in the track between the first and second portions.

11. The stabilizer of claim 1, wherein the cavity is defined by elongated opposing walls formed in the body.

12. The stabilizer of claim 11, wherein the body further comprises an aperture defined in at least one wall, the aperture extending through the wall to an exterior surface of the body.

13. The stabilizer of claim 1, further comprising a locking mechanism mounted on an end of the elongated shaft, the lock washer comprised of a ring defined around an axis, the ring having at least 3 fingers disposed on a perimeter of the ring, wherein each finger is angled from the perimeter towards the axis of the ring, the lock washer further comprising an arm extending from the ring away from the fingers in a direction opposite the fingers, the arm having a tab extending radially outward.

14. The stabilizer of claim 13, wherein each finger has a flat distal end.

15. A stabilizer for use in a drill string, the stabilizer comprising:

a body with an elongated axis, the body having an elongated cavity formed in an exterior surface of the body;

an elongated stabilizer blade having a first end, a second end, an outer surface and an inner surface with a track formed along the inner surface;

a sliding block having top, a bottom and a threaded through bore formed in the block along a through bore axis;

an elongated shaft having a first end and a second end and having an exterior surface at least partially threaded between the first end and the second end, wherein the threaded surface of the shaft engages the threaded through bore of the sliding block; and a guideway assembly, the guideway assembly comprising a first track and first follower slidingly securing the bottom of the sliding block to the body and a second track and second follower slidingly securing the top of the sliding block to the removable blade;

wherein the first follower is formed along a plane that is parallel with the through bore axis and he second follower is formed along a plane that forms an angle with the through bore axis, wherein the first and second followers are flanges that extend from the sliding block.

16. The stabilizer of claim 15, wherein the first track is disposed within the elongated cavity of the body and the first follower extends from adjacent the bottom of the sliding block.

17. The stabilizer of claim 15, wherein the second track is disposed adjacent the inner surface of the blade and the second follower extends from adjacent the top of the sliding block.

18. The stabilizer of claim 15, wherein each track comprises a set of spaced apart grooves and each follower comprises two flanges extending from the sliding block and disposed to engage the respective grooves of the tracks.

* * * * *